US006988781B2

(12) United States Patent
Dang et al.

(10) Patent No.: US 6,988,781 B2
(45) Date of Patent: Jan. 24, 2006

(54) AIRTIGHT BLAST RESISTANT CARGO CONTAINER

(75) Inventors: Xinglai Dang, Carlsbad, CA (US); Philemon Chan, San Diego, CA (US); James Stuhmiller, Rancho Santa Fe, CA (US)

(73) Assignee: Jaycor, San Diego, CA (US)

( * ) Notice: Subject to any disclaimer, the term of this patent is extended or adjusted under 35 U.S.C. 154(b) by 120 days.

(21) Appl. No.: 10/330,718

(22) Filed: Dec. 27, 2002

(65) Prior Publication Data

US 2004/0123783 A1 Jul. 1, 2004

(51) Int. Cl.
*A47B 96/00* (2006.01)

(52) U.S. Cl. ..... 312/409

(58) Field of Classification Search ..... 312/409, 312/109; 109/1 S, 69, 75, 77; 220/1.5, 88.1, 220/345.1, 345.2, 345.4, 345.6
See application file for complete search history.

(56) References Cited

U.S. PATENT DOCUMENTS

| | | | | | |
|---|---|---|---|---|---|
| 718,878 | A | * | 1/1903 | Reynolds et al. | 70/140 |
| 900,696 | A | * | 10/1908 | Baum | 109/77 |
| 1,259,153 | A | | 3/1918 | Standish | |
| 2,739,730 | A | | 3/1956 | Jonas | |
| 2,884,296 | A | | 4/1959 | Meilinger | |
| 3,180,697 | A | | 4/1965 | Mulch | |
| 3,490,824 | A | | 1/1970 | Bartlett et al. | |
| 3,915,327 | A | * | 10/1975 | Lovich et al. | 220/1.5 |
| 4,187,758 | A | * | 2/1980 | Petty | 86/50 |
| 4,216,927 | A | | 8/1980 | Byrd | |
| 4,478,350 | A | | 10/1984 | Ohlsson | |
| 4,542,545 | A | * | 9/1985 | Johnson et al. | 4/555 |
| 4,878,415 | A | | 11/1989 | Foster et al. | |
| 4,998,634 | A | * | 3/1991 | Nessfield | 220/1.5 |
| 5,195,701 | A | | 3/1993 | Willan | |
| 5,267,665 | A | | 12/1993 | Sanai | |
| 5,312,182 | A | | 5/1994 | Mlakar et al. | |
| 5,360,129 | A | | 11/1994 | Lee | |
| 5,390,580 | A | | 2/1995 | Gibbons, Jr. et al. | |
| 5,413,410 | A | | 5/1995 | Mlakar | |
| 5,435,641 | A | * | 7/1995 | Dumon Dupuis et al. | 312/223.1 |
| 5,595,431 | A | | 1/1997 | Mlakar | |
| 5,599,082 | A | | 2/1997 | Mlakar et al. | |
| 5,645,184 | A | | 7/1997 | Rowse et al. | |
| 5,769,257 | A | | 6/1998 | Fleisher et al. | |
| 6,019,237 | A | | 2/2000 | Durham et al. | |
| 2001/0017508 | A1 | * | 8/2001 | Caldwell et al. | 312/326 |

FOREIGN PATENT DOCUMENTS

| | | | |
|---|---|---|---|
| EP | 139537 | * | 5/1985 |

* cited by examiner

*Primary Examiner*—James O. Hansen
(74) *Attorney, Agent, or Firm*—Nydegger & Associates

(57) ABSTRACT

A cargo container of unitary construction surrounds a cargo hold and has an opening into the cargo hold defined by an edge. A flange extends along the edge of the opening and projects into the cargo hold to form a seat. A door having a panel defined by a border covers the opening. A bite extends along the border of the panel and projects away from the panel to contact the seat. When the door is covering the opening, the bite is positioned against the seat and is juxtaposed with the flange. In response to an explosive detonation in the cargo hold, the bite is forced against the seat and transfers the explosive force from the door to the container. If a seal is present on the seat, the bite is forced against the seal to form an airtight lock in the cargo container.

14 Claims, 9 Drawing Sheets

AIRTIGHT BLAST RESISTANT CARGO CONTAINER

FIELD OF THE INVENTION

The present invention pertains generally to load containment devices. More particularly, the present invention pertains to cargo containers that will resist the blast effect of an explosive detonation inside the cargo container. The present invention is particularly, but not exclusively, useful for containing luggage and other cargo during transport by aircraft.

BACKGROUND OF THE INVENTION

Aircraft are attractive targets for political terrorists. Specifically, terrorists have placed bombs aboard aircraft to murder passengers and crewmembers that are also aboard the aircraft, and to cause further damage to persons and structures on the ground. This form of terrorist act often provokes an intense public reaction that has a substantial political impact.

Despite the use of extremely tight security procedures and sophisticated explosive detecting equipment, terrorists have still been able to place bombs aboard aircraft. One method used by terrorists to place a bomb aboard an aircraft is to hide the bomb in a passenger's luggage or in other items that are stored and carried in the cargo compartment of the aircraft. Terrorists have been able to use this method because small bombs cannot be easily detected through ordinary screening methods. One approach to solving this problem is to institute elaborate and intrusive screening methods. Another way to deal with this problem is to mitigate the potential damage that could be caused by a small bomb detonating aboard the aircraft.

In the airline industry, it is a standard practice to place cargo into a containment device, which is commonly referred to as Unit Load Devices (ULDs). The shape, size and weight of a ULD for a given type aircraft has been fairly well standardized due to practical considerations and regulatory requirements. Consequently, a typical ULD is in the shape of a box having sloped surfaces that conform the ULD to the aircraft's fuselage when the ULD is placed in the aircraft's cargo compartment. The ULD is often made of several panels, which are joined together at their edges to surround a cargo hold. Additionally, the ULD has an opening to provide access to the cargo hold, and a door for covering the opening. Cargo is placed into, or removed from, the cargo hold through the opening.

A ULD designed to withstand an explosive blast in the cargo hold should also conform to these practical considerations and regulatory requirements. Additionally, a blast resistant ULD may include other structures, or be formed from particular materials, to resist an explosive blast. For example, the panels in a blast resistant ULD may be structured to resist tensile stresses that are directed toward the plane of the panel. In response to an internal explosion, these panels tend to bulge outwardly from the explosive source but are effective in resisting rupture.

Stress analysis performed on existing ULDs show that the highest tension stress concentrations caused by an explosive blast within the cargo hold will occur at the edges where the panels have been joined together and at the door around the opening. Consequently, more material is often added to ULDs at these points of highest tension stress concentration to better contain an internal explosion. This additional material, however, adds cost and additional weight to the ULD, and may reduce the size of the cargo hold.

In light of the above, it is an object of the present invention to provide a containment device that is able to resist an internal explosive blast without rupturing the device. Another object of the present invention is to provide a containment device that reduces tension stress concentrations caused by an internal explosive blast. Yet another object of the present invention is to provide a containment device that meets the regulatory standards for the use of such devices in air transport operations. Still another object of the present invention is to provide a containment device that allows relatively easy access to a cargo hold located inside the cargo container. Another object of the present invention is to provide a containment device that is easy to use, relatively easy to manufacture, and comparatively cost effective.

SUMMARY OF THE INVENTION

In accordance with the present invention, an explosion resistant containment device is provided for containing luggage and other cargo during air transport. The device includes a container formed by joining panels in a unitary construction to reduce tension stress concentrations on the container that may be caused by an explosive denotation in the cargo hold. Additionally, the container includes interior surfaces surrounding a cargo hold. The interior surfaces include a top surface and a bottom surface that are substantially parallel to each other, a back surface and a front surface that are substantially parallel to each other, and a left surface and a right surface that are substantially parallel to each other.

The container also includes an opening defined by an edge for providing access to the cargo hold. A flange extends inwardly from the edge of the opening to establish a seat between the flange and the portion of the container surrounding the opening. The flange is continuous with the portion of the container surrounding the opening and is part of the unitary construction of the container.

An internally retracting door for covering the opening includes a substantially flat door panel having a front side circumscribed by edges forming a border. The edges of the door panel are substantially perpendicular to the front side of the door panel. Additionally, the door includes a bite on the front side of the panel at the border, which extends away from the front side of the panel in a substantially perpendicular direction. A core formed in the bite may be either hollow or solid. The door is dimensioned so that the bite can be juxtaposed with the flange to cover the opening with the panel when the bite is positioned against the seat. Furthermore, the panel and the bite are constructed with a composite material having a high strength to weight ratio.

The door also includes one or more handles mounted to the front side of the panel, and may include one or more handles mounted to edges of the door. The handles can be used for moving the door while opening and closing the door. When the door is being opened, the door retracts into the interior of the container. When the door is being closed, the door is retrieved from the interior of the container and the bite is positioned against the seat to cover the opening with the door panel. Additionally, the flange and the bite each have a number of corresponding bolt holes that line up with each other when the bite is positioned against the seat. When the bite is positioned against the seat, a bolt may be inserted into each pair of corresponding bolt holes to hold the door over the opening.

As a result of an explosive detonation in the cargo hold, an explosive force is exerted against the door panel and the container. The explosive force is transferred from the door panel to the bite and subsequently to the container at the seat. Optionally, a seal may be affixed to the seat. If used, the seal will transfer the explosive force to the container at the seat. Additionally, the bite minimizes door warping that may be caused by the explosive force on the door.

When used, the seal establishes an air-tight lock between the bite and the container in response to an internal pressure in the cargo container. Specifically, an explosion in the cargo hold creates sufficient internal pressure in the interior of the cargo container to press the bite against the seal to form the airtight lock. When the container is sealed, gasses are prevented from escaping the cargo hold and gasses are also prevented from entering the cargo hold.

In one embodiment of the containment device, a top cradle is mounted to the top surface of the container and a bottom cradle is mounted to the bottom surface of the container. The door is positioned between the top cradle and the bottom cradle to guide the door while the door is being opened or closed. Additionally, the bottom cradle includes a plate for supporting the door.

In an alternate embodiment of the containment device, the door includes a right surface and a left surface that are substantially parallel to each other. Axels are mounted to the left and right edges of the door and rollers are mounted to the axels. Additionally, guide rails are mounted to the left and right sides of the container to guide the rollers while the door is being opened or closed.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
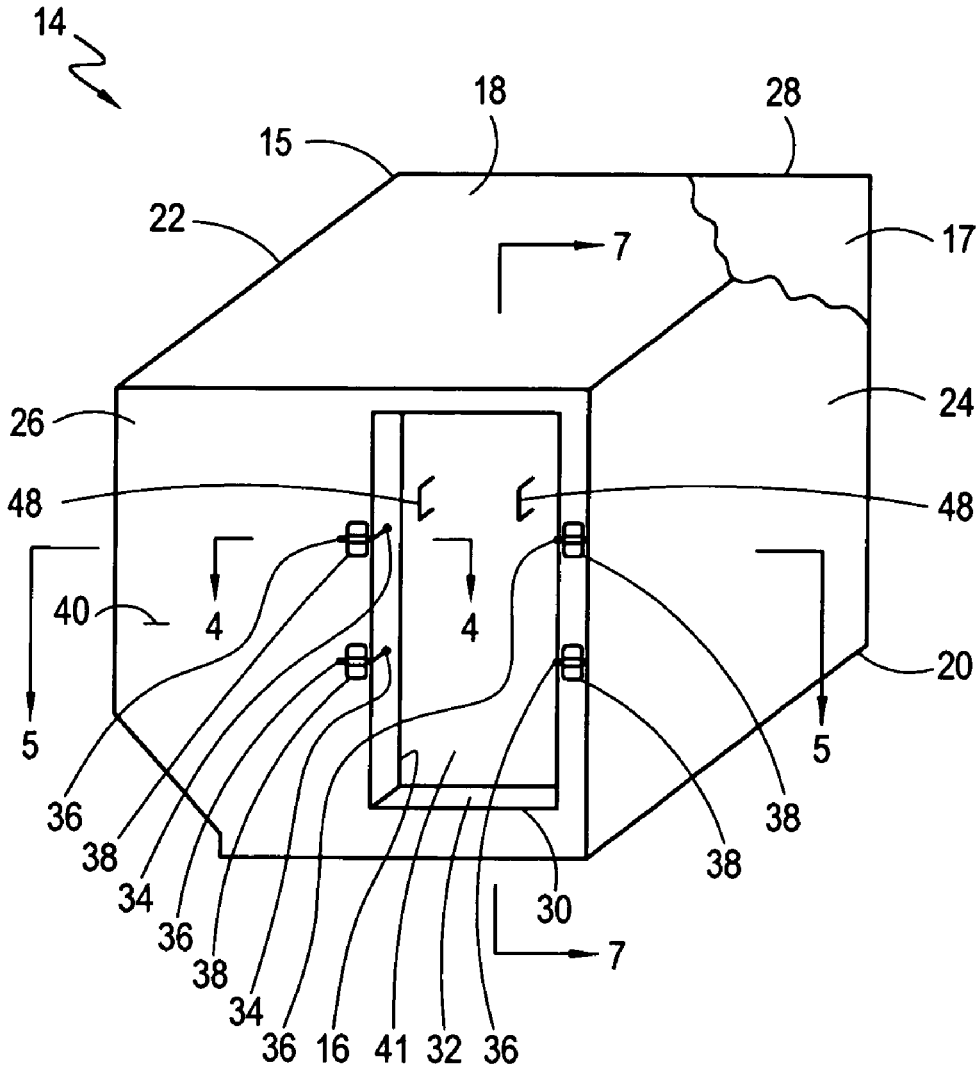
FIG. 1 is a perspective view of a device according to the present invention, with a portion broken away for clarity.

Referring initially to FIG. 1, the explosion resistant containment device of the present invention is shown and is generally designated 14. The containment device 14 includes a container 15, which is formed with an opening 16. Preferably, the container 15 is constructed with a plurality of substantially flat panels, which are joined at their peripheries where the panels intersect each other to surround a cargo hold 17. Exemplary panels for the container 15 include a top panel 18, a bottom panel 20, a left panel 22, a right panel 24, a front panel 26 and a back panel 28. Preferably, the container 15 is formed with a composite material in a unitary construction to maximize the overall structural strength of the container 15. Specifically, the unitary construction reduces the likelihood of tension stress concentration on the joints between the panels 18, 20, 22, 24, 26 and 28. Moreover, the composite material used for the construction of the container 15 should exhibit a high strength to weight ratio to resist an internal blast, contain fragments and prevent shock holing. For example, SPECTRA and KEVLAR are composite materials with high strength to weight ratios that can be used in the present invention.

For purposes of the present invention, the opening 16 provides access to the cargo hold 17 for placing luggage and cargo into the container 15. The opening 16, which is preferably located in the front panel 26, is defined by an edge 30. A flange 32 surrounds the opening 16 and extends into the cargo hold 17 from the edge 30 of the opening 16. The flange 32 is substantially perpendicular to the front panel 26 and is formed to be continuous with the container 15 in a unitary construction. For purposes of the present invention, bolt holes 34 are formed through the flange 32 in a direction substantially parallel to the front panel 26 of the container 15. The bolt holes 34 are formed to accommodate corresponding bolts 36 that may be included in the containment device 14. Additionally, bolt brackets 38 are mounted to an exterior surface 40 of the front panel 26 near the bolt holes 34. Each bolt bracket 38 includes a bolt hole 39 (FIG. 4) constructed to accommodate the corresponding bolt 36.

Figure 2:
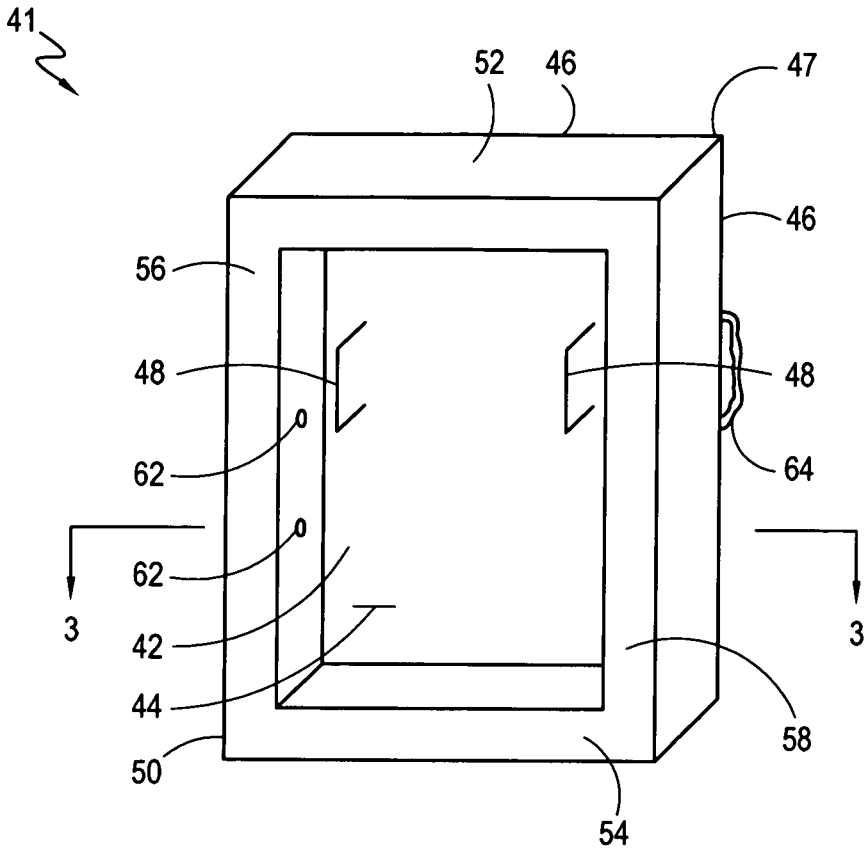
FIG. 2 is a perspective view of a door used in the device shown in FIG. 1.

As shown in FIG. 1, the containment device 14 also includes a door 41, which is used to cover the opening 16. Referring now to FIG. 2, the door 41 includes a door panel 42. A front side 44 of the door panel 42 has a substantially planer surface that is circumscribed by edges 46 forming a border 47. The edges 46 are substantially perpendicular to the front side 44 of the door panel 42. Preferably, the door panel 42 is constructed of a high strength to weight material that is the same composite material used to construct the container 15. Additionally, the door 41 includes one or more door handles 48 that are mounted on the front side 44 of the door panel 42. Although the containment device 14 is shown and described as having only one opening 16 and one door 41, it will be appreciated that the container 15 may have additional doors 41 and corresponding openings 16. Moreover, the opening 16 and the door 41 may have geometric shapes other than a square or rectangular shape, and the opening 16 may be formed on a panel other than the front panel 26.

Figure 3:
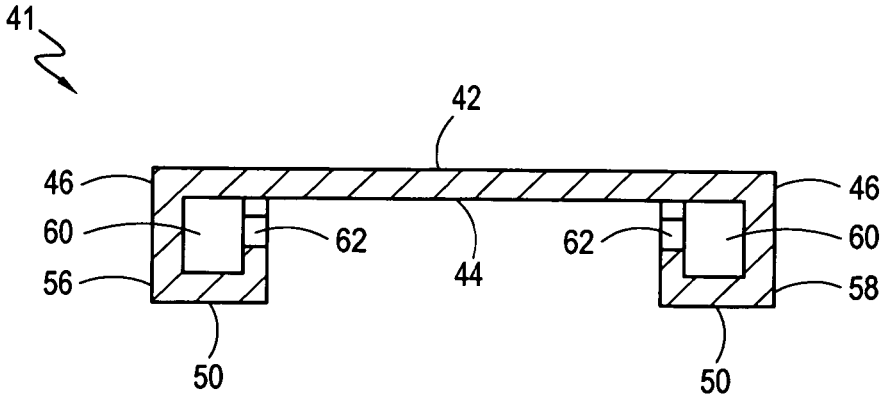
FIG. 3 is a cross-sectional view of the door as seen along the line 3—3 in FIG. 2.

As shown in FIG. 2, the generally designated door 41 includes a bite 50 that is formed along the edges 46 of the door panel 42 and extends in a perpendicular direction away from the front side 44 of the door panel 42. The bite 50 includes a top section 52 that is substantially parallel to a bottom section 54, and a left section 56 that is substantially parallel to a right section 58. As shown in FIG. 3, the bite 50 has a core 60, which may be hollow or solid. Furthermore, the bite 50 has a number of bolt holes 62 formed through the left section 56 and the right section 58 of the bite 50 in a direction substantially parallel to the front side 44 of the door panel 42 and substantially perpendicular to the edges 46 of the door panel 42. The bolt holes 62 in the bite 50 are substantially the same size as the bolt holes 34 in the flange 32 and are formed to accommodate the corresponding bolts 36 (FIG. 1). Preferably, the bite 50 is constructed of a high strength to weight material that is the same material used to construct the container 15 (FIG. 1) and the door panel 42. Referring to FIG. 2, the door 41 may include one or more side handles 64 mounted to the door 41. Preferably, one side handle 64 is mounted to the right section 58 of the door 41 as shown in FIG. 2.

Figure 4:
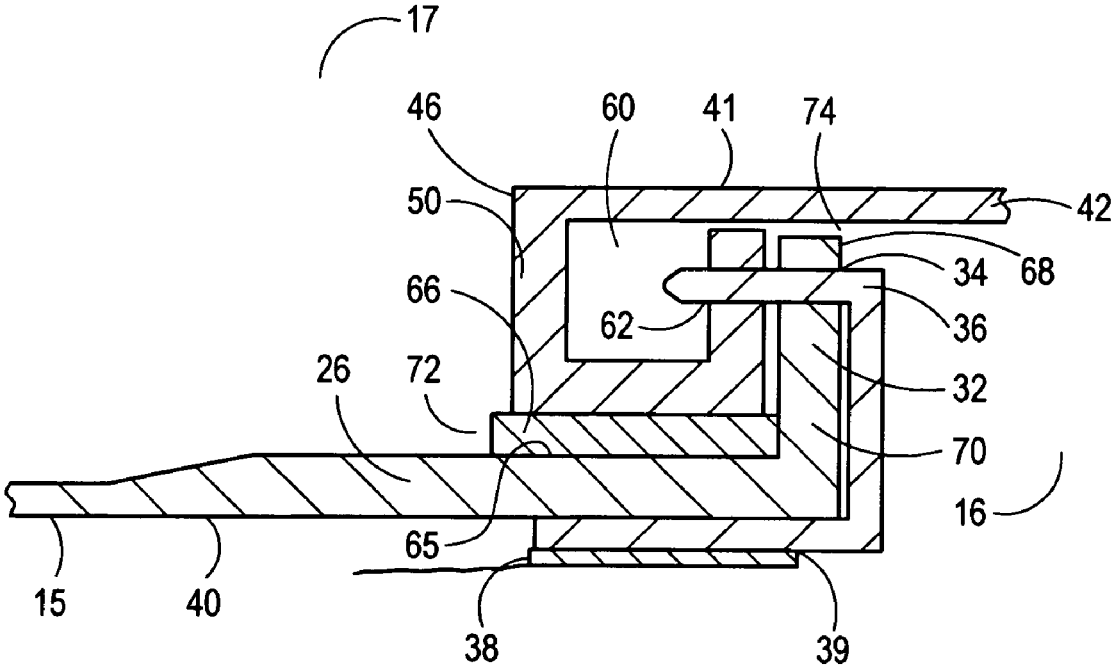
FIG. 4 is a cross-sectional view of a portion of the device as seen along the line 4—4 in FIG. 1, showing the door secured in the container, with portions broken away for compactness and clarity.

More details of the door 41 are shown in FIG. 4. When the door 41 is covering the opening 16, the flange 32 is juxtaposed with the bite 50 and the door panel 42 is substantially perpendicular to an end 68 of the flange 32. Preferably, the door panel 42 is slightly separated from the end 68 of the flange 32 as shown in FIG. 4. Moreover, the flange 32 and an interior surface 65 of front panel 26 form an L-shaped seat 70. Preferably, the seat 70 is formed with additional layers of composite material to strengthen the container 15 around the opening 16. As shown in FIG. 4, seat 70 is shaped to contact the bite 50 when the door 41 is covering the opening 16.

As shown in FIG. 4, an optional seal 66 may be affixed to the interior surface 65 of front panel 26 at the seat 70. When the door 41 is covering the opening 16 and the bite 50 is juxtaposed with the flange 32, the seal 66 is between the bite 50 and the front panel 26 of the container 15, and the bite 50 is pressed against the seal 66. Preferably, the seal 66 is made from a readily available commercial elastomeric material that can maintain effectiveness at high pressure over a range of temperature conditions. For example, the seal 66 may be made of rubber, neoprene, or polyurethane. Furthermore, the seal 66 may be a commercially available gasket, engine seal, O-ring or submersible seal. Preferably, the seal 66 is a long continuous strip that is form fitted and affixed to the front panel 26 at the seat 70, and which mates smoothly with the bite 50 when the door 41 is covering the opening 16.

When the door 41 is covering the opening 16, one end of the bolt 36, which preferably has a U-shape construction, is positioned into the bolt hole 34 of the flange 32 and into the bolt hole 62 of the bite 50. As shown in FIG. 4, the bolt hole 34 is substantially coaxial with the bolt hole 62 when the bolt 36 is positioned into the bolt holes 34 and 62. Additionally, the other end of the bolt 36 is positioned into the bolt hole 39 in the bolt bracket 38. As shown in FIG. 4, the bolt hole 39 in the bolt bracket 38 is substantially parallel to the bolt hole 34 in the flange 32 and the bolt hole 62 in the bite 50. When positioned into the bolt holes 34, 39 and 62, the bolt 36 conforms to a portion of the front panel 26 of the container 15 and the flange 32 to hold the door 41 over the opening 16. It will be appreciated that the bolts 36, the bolt brackets 38, and bolt holes 34, 39 and 62 are optional in the containment device 14, and that other mechanisms known in the art may be used to hold the door 41 over the opening 16.

Alternatively, the seal 66 may be absent from the front panel 26 of the container 15. In this situation, the bite 50 is pressed against the seat 70 and the door panel 42 is pressed against the end 68 of the flange 32 when the door 41 is covering the opening 16 and the bolts 36 are positioned in the bolt holes 34, 39 and 62. Preferably, a gap 72 exists between the bite 50 and the seat 70 and another gap 74 exists between the door panel 42 and the end 68 of the flange 32 when the bite 50 is pressed against the seat 70. Referring to FIG. 4, it can be seen that the gap 72 exists between the bite 50 and the front panel 26 of the container 15 when the seal 66 is absent from the front panel 26.

Figure 5:
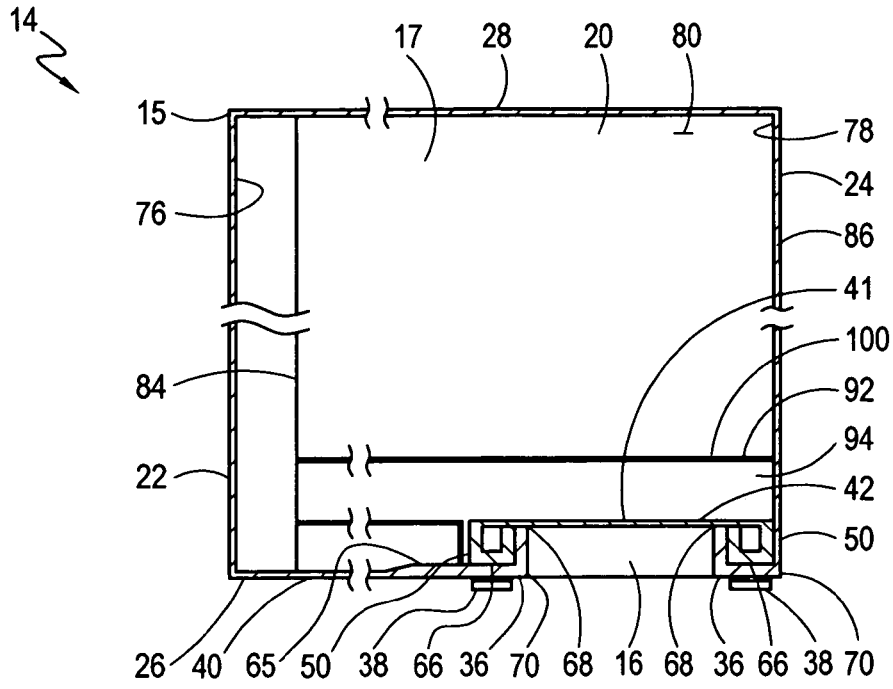
FIG. 5 is a cross-sectional view of the device as seen along the line 5—5 in FIG. 1.
Figure 6:
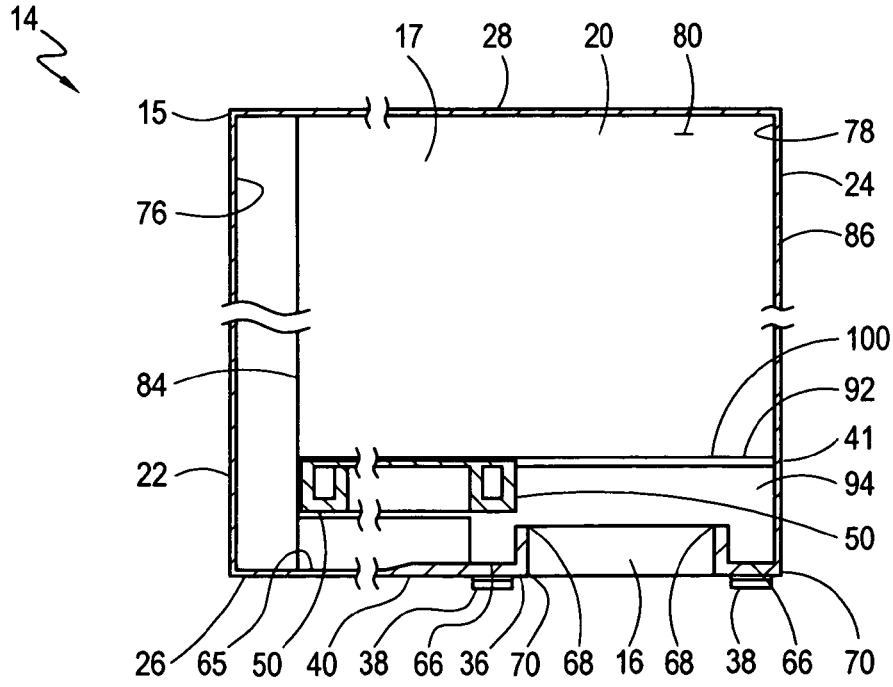
FIG. 6 is a cross-sectional view of the device as seen along the line 5—5 in FIG. 1, showing the door fully retracted into the cargo hold.
Figure 7:
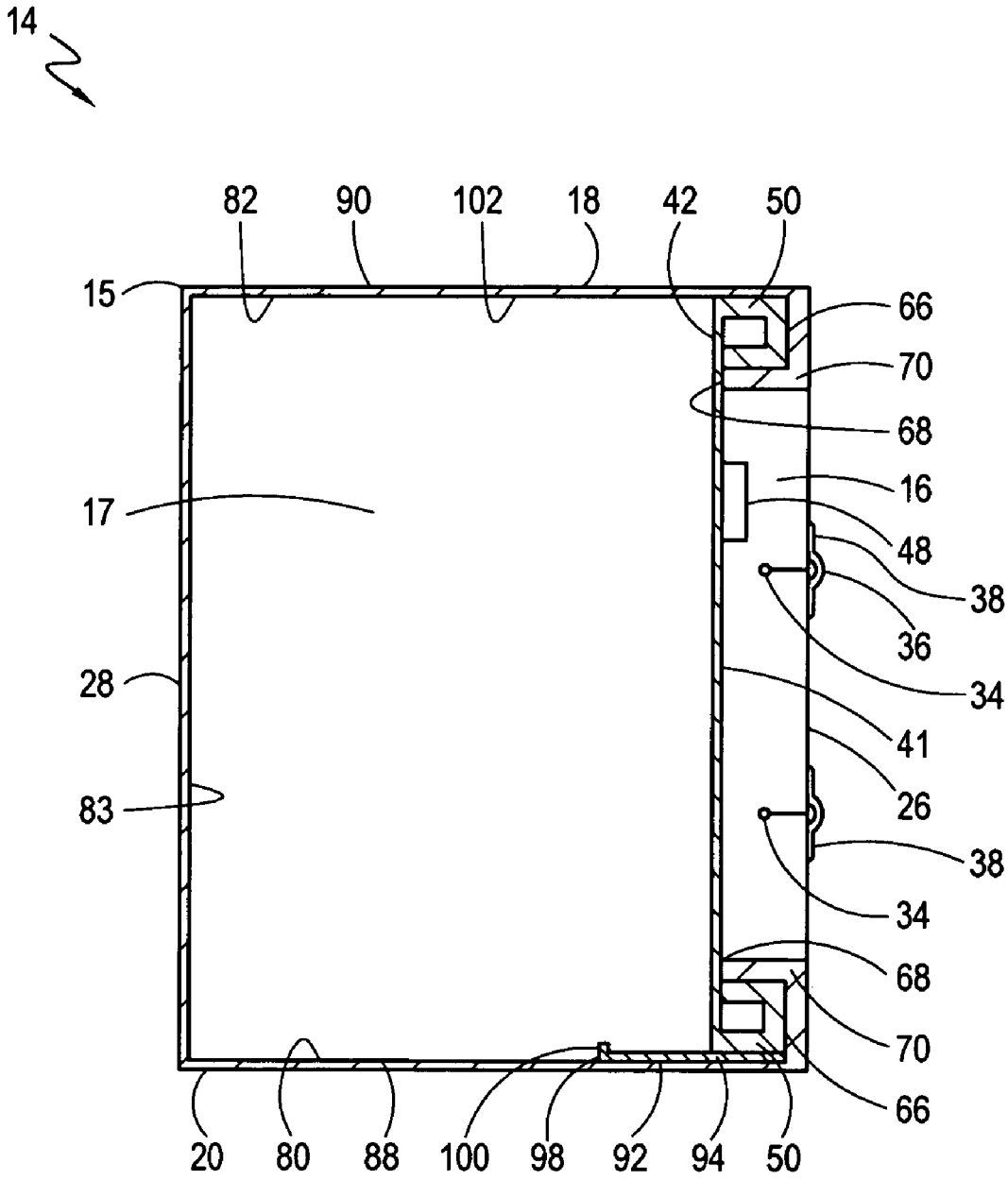
FIG. 7 is a cross-sectional view of the device as seen along the line 7—7 in FIG. 1.

More details of the door 41 are shown in FIGS. 5 and 6. The left panel 22 of the container 15 has an interior surface 76 and the right panel 24 of the container 15 has an interior surface 78. Additionally, the bottom panel 20 has an interior surface 80. As shown in FIG. 7, the top panel 18 has an interior surface 82 and the back panel 28 has an interior surface 83. Referring to FIGS. 5 and 6, the container 15 includes a left bracket 84 and a right bracket 86. Preferably, the left bracket 84 and the right bracket 86 are planar surfaces that are substantially parallel to each other and to the left panel 22 and the right panel 24 of the container 15. The left bracket 84 and the right bracket 86 may be mounted to one or more panels 18, 20, 22, 24, 26 or 28 of the container 15. Additionally, the left panel 22 or the right panel 24 may form the left bracket 84 or right bracket 86, respectively. For example, the right panel 24 forms right bracket 86 as shown in FIGS. 5 and 6.

Referring to FIG. 7, the container 15 also includes a bottom bracket 88 and a top bracket 90. Preferably, the bottom bracket 88 and the top bracket 90 are planar surfaces that are substantially parallel to each other and to the top panel 18 and the bottom panel 20 of the container 15. The bottom bracket 88 and the top bracket 90 may be mounted to one or more panels 18, 20, 22, 24, 26 or 28 of the container 15. Preferably, the top panel 18 and the bottom panel 20 form the top bracket 90 and the bottom bracket 88 respectively, as shown in FIG. 7.

Figure 8:
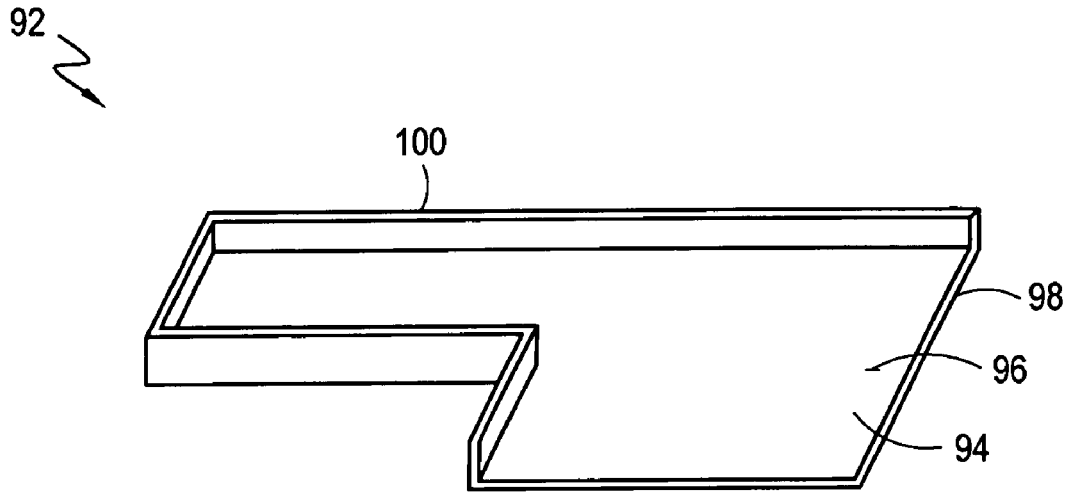
FIG. 8 is a perspective view of the bottom cradle shown in FIGS. 5, 6 and 7.

A containment device 14 in which the door 41 interacts with the container 15 in a substantially lateral direction is shown in FIGS. 5, 6 and 7. As seen in FIGS. 5 and 6, a bottom cradle 92 is mounted to the bottom panel 20. More details of the bottom cradle 92 are shown in FIG. 8. The bottom cradle 92 includes a plate 94 for supporting the door 41 (FIG. 7). The plate 94 has a substantially planer top surface 96 that is circumscribed by a border 98. The bottom cradle 92 also includes a frame 100 mounted to the top surface 96 of the plate 94 along the border 98. The frame 100 extends away from a top surface 96 of the plate 94 in a direction substantially perpendicular to the top surface 96. Preferably, the frame 100 is formed along only a portion of the border 98 as shown in FIG. 8. The bottom cradle 92 may engage the left bracket 84, the right bracket 86, and the interior surface 65 of front panel 26 (FIG. 6). Additionally, the bottom cradle 92 may be mounted to the left bracket 84, the right bracket 86, or the interior surface 65 of front panel 26.

Figure 9:
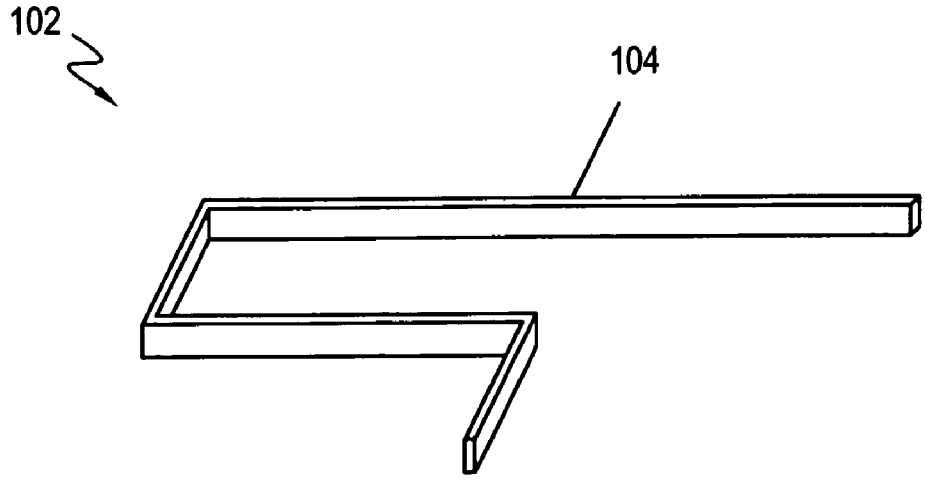
FIG. 9 is a perspective view of the top cradle shown in FIG. 7.

As shown in FIG. 7, a top cradle 102 is mounted to the top panel 18. More details of the top cradle 102 are shown in FIG. 9. The top cradle 102 has a frame 104 that preferably has the same dimensions and structure as the frame 100 of the bottom cradle 92 (FIG. 8). The top cradle 102 may engage the left bracket 84, the right bracket 86, and the interior surface 65 of front panel 26 (FIG. 6). Additionally, the top cradle 102 may be mounted to the left bracket 84, the right bracket 86, or the interior surface 65 of front panel 26.

Figure 10:
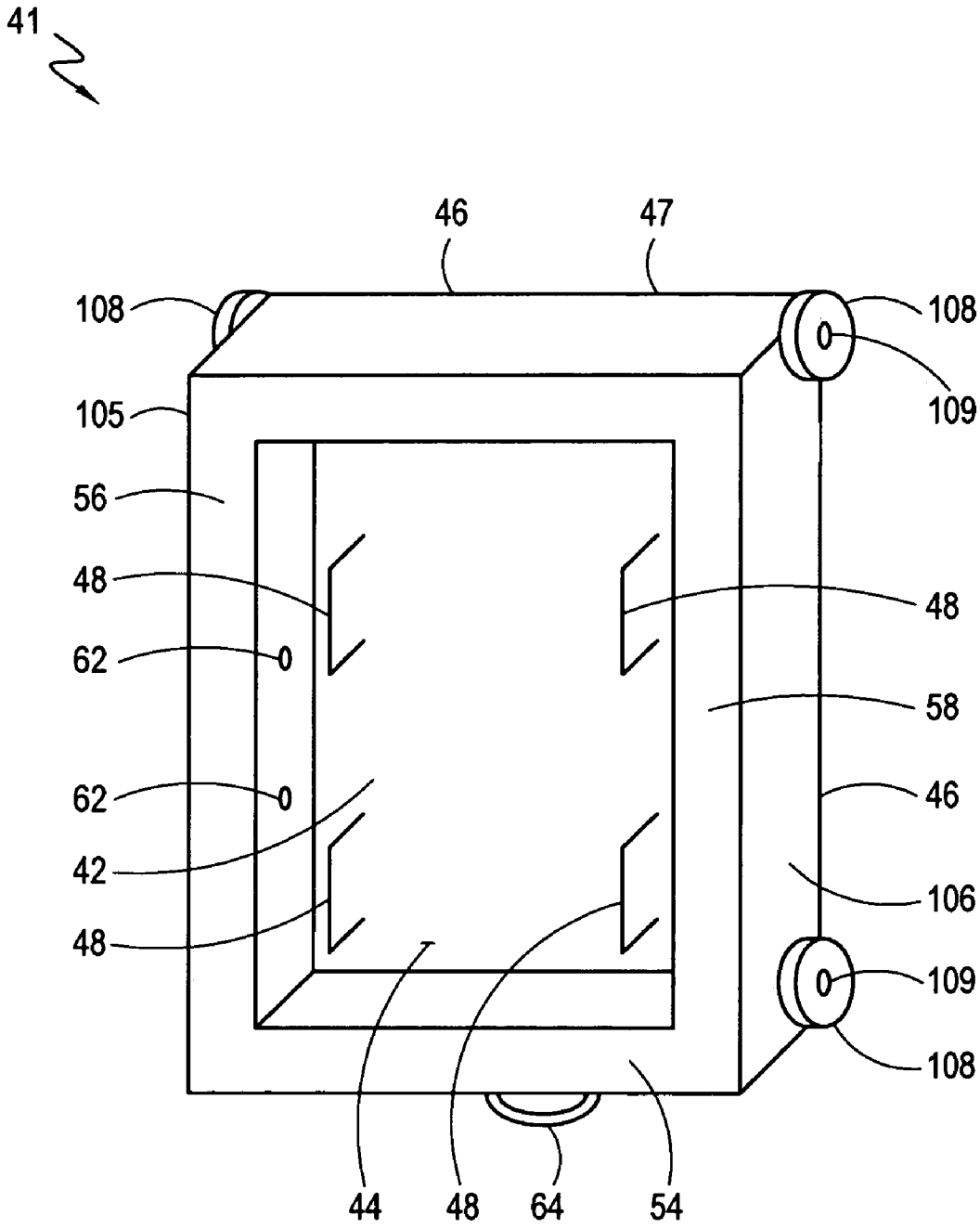
FIG. 10 is a perspective view of a door used in the device shown in FIG. 1.
Figure 11:
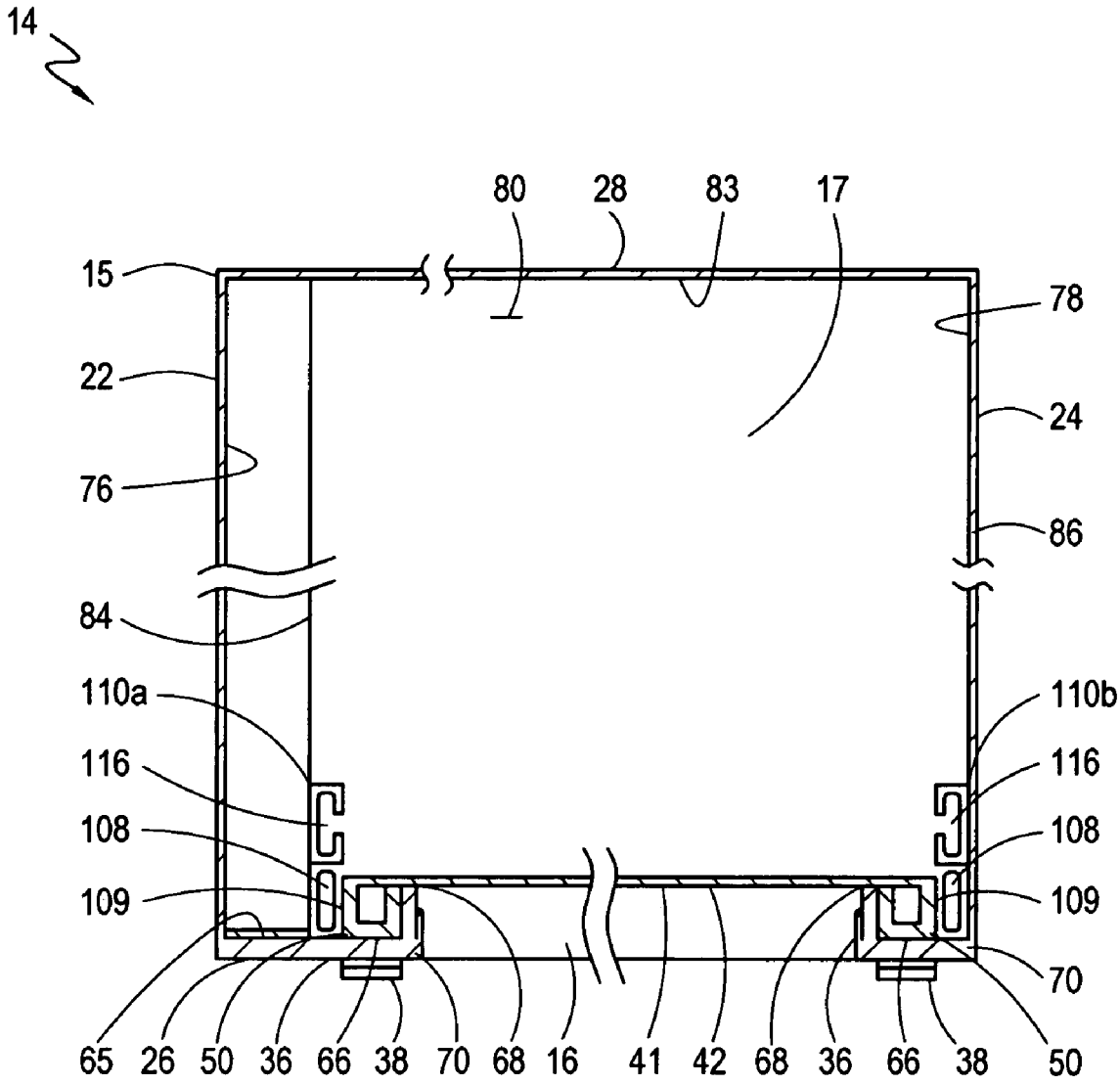
FIG. 11 is a cross-sectional view of the device as seen along the line 5—5 in FIG. 1.
Figure 12:
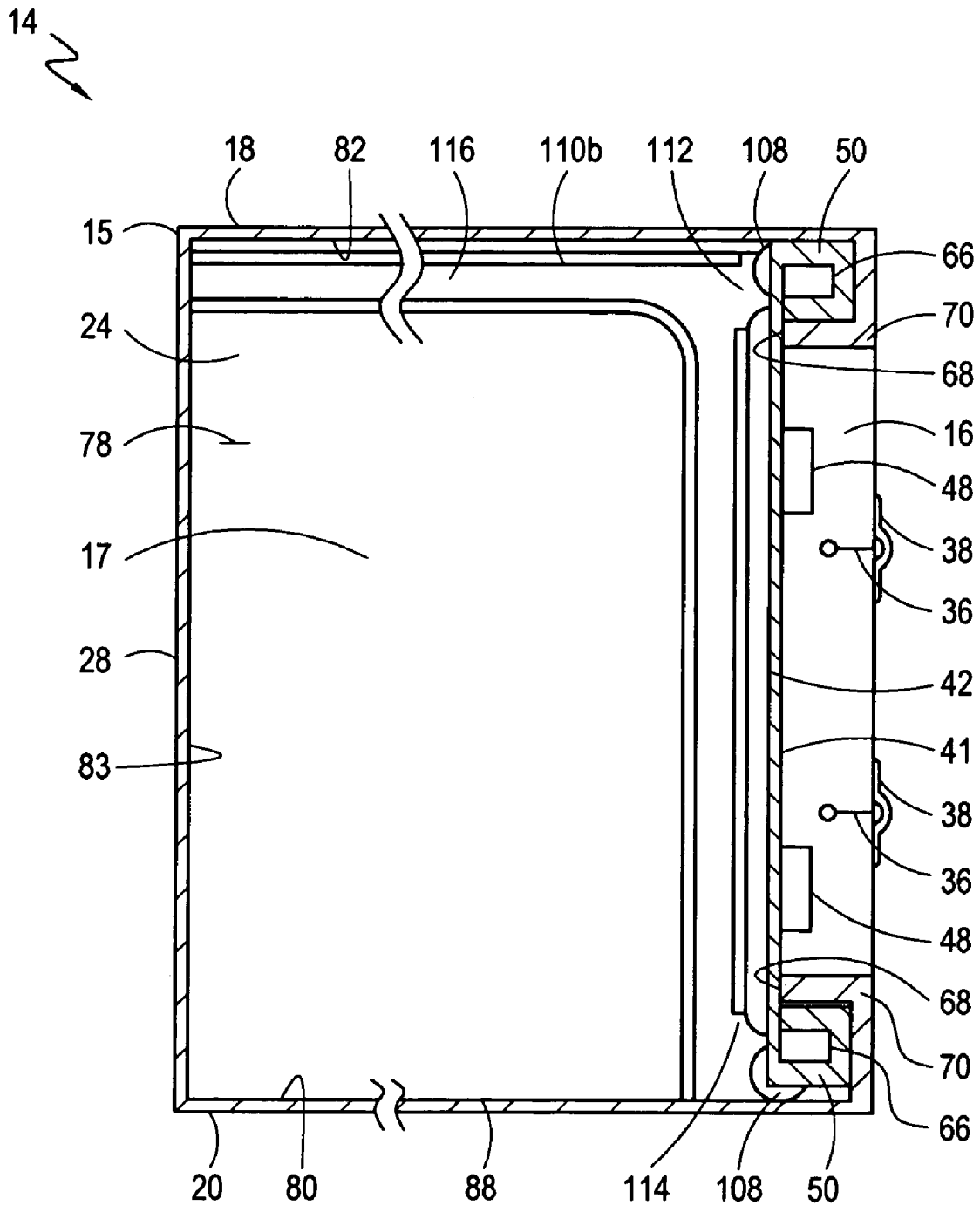
FIG. 12 is a cross-sectional view of the device as seen along the line 7—7 in FIG. 1.

A containment device 14 in which the door 41 interacts with the container 15 in a substantially upright direction is shown in FIGS. 10, 11 and 12. As shown in FIG. 10, the door 41 has an outside surface 105 on the left section 56 of the bite 50 along the border 47 of the door panel 42. Additionally, the door 41 has an outside surface 106 on the right section 58 of the bite 50 along the border 47 of the door panel 42. Rollers 108 are mounted to the outside surface 105 of the left section 56 and to the outside surface 106 of the right section 58 with axles 109. Preferably, the door 41 includes four door handles 48 mounted to the front side 44 of the door panel 42. The door 41 may also include one or more side handles 64, preferably mounted to the bottom section 54 of the bite 50.

As shown in FIG. 11, guide rails 110*a* and 110*b* are respectively mounted to the left bracket 84 and right bracket 86 in the container 15. Preferably, the right bracket 86 is the right panel 24 of the container 15, and the guide rail 110*b* is mounted directly to the right panel 24. Additionally, the left bracket 84 may be the left panel 22 of the container 15, in which case the guide rail 110*a* is mounted directly to the left panel 22. As shown in FIG. 11, the guide rails 110*a* and 110*b* are offset from the interior surface 65 of the front panel 26 to accommodate the rollers 108 that are positioned between the front panel 26 and the guide rails 110*a* and 110*b*.

Referring to FIG. 12, the guide rails 110*a* (FIG. 11) and 110*b* have an upper opening 112 and a lower opening 114 that are slightly larger than a diameter of the rollers 108. Furthermore, the guide rails 110*a* and 110*b* have a T-shaped or L-shaped slot 116 that is dimensioned to accommodate the rollers 108 and the axles 109. The upper opening 112 and the lower opening 114 provide access to the slot 116 for the rollers 108. Preferably, the slot 116 closely conforms to the shape of the rollers 108 and the axels 109. For example, the slot 116 may have a wider portion to surround the rollers 108 and a narrow portion to surround the axles 109, as shown in FIG. 11.

The guide rails 110*a* and 110*b* can be described in greater detail with reference to FIGS. 11 and 12. As shown in FIG. 12, the guide rail 110*b* is mounted to the right panel 24 of the container 15. It will be appreciated that the structure of the guide rail 110*a* may differ from the structure of the guide rail 110*b*, but that the guide rail 110*a* can be described referring to the guide rail 110*b* shown in FIG. 12 and FIG. 11. Preferably, the guide rails 110*a* and 110*b* engage the interior surface 82 of the top panel 18, the interior surface 83 of the back panel 28, and the interior surface 80 of the bottom panel 20. The guide rails 110*a* and 110*b* extend from the bottom panel 20 to the top panel 18 in a direction substantially parallel to the interior surface 65 of the front panel 26. At the top panel 18, the guide rails 110*a* and 110*b* curve and extend toward the back panel 28 in a direction substantially parallel to the interior surface 82 of top panel 18.

For the operation of the containment device 14, the door 41 is retracted into the cargo hold 17 to uncover the opening 16, as shown in FIG. 6. While the door 41 is being retracted into the cargo hold 17, the bolts 36 are absent from the bolt holes 62 in the bite 50 of the door 41. Preferably, the bolts 36 are also absent from the bolt holes 34 of the flange 32 and the bolt holes 39 of the bolt bracket 38 (FIG. 4). The door 41 may be retracted into the cargo hold 17 in either a substantially lateral direction or a substantially upright direction.

Operation of a containment device 14 in which the door 41 interacts with the container 15 in a substantially lateral direction is best described with reference to FIGS. 4, 5, 6 and 7. As shown in FIGS. 4 and 5, the door 41 is covering the opening 16, and the bolts 36 are positioned in the respective bolt holes 34, 39 and 62 of the flange 32, the bolt bracket 38 and the bite 50 of the door 41. Before opening the door 41 to uncover the opening 16, an operator removes the bolts 36 from the bolt holes 34, 39 and 62. The operator then pushes the door 41 toward the back panel 28 of the container 15 until the top cradle 102 and the frame 100 of the bottom cradle 92 restrict further movement of the door 41. Preferably, the operator pushes on the door handles 48 to move the door 41 toward the back panel 28. As the operator pushes on the door handles 48, the door 41 retracts into the cargo container 15 in a substantially lateral direction.

The operator then pushes the door 41 in a substantially lateral direction toward the left panel 22 until the top cradle 102 and the frame 100 of the bottom cradle 92 that are near the left bracket 84 restrict further movement of the door 41, as shown in FIG. 6. Preferably, the operator uses the door handles 48 and the side handles 64 to push the door 41 toward the left panel 22. As the operator pushes on the door handles 48 and the side handle 64, the door 41 retracts further into the cargo hold 17. With the door 41 opened, the operator has access to the container 15 through the opening 16 to place items into, and remove items from, the cargo hold 17.

To close the door 41, the operator pulls on the door handle 48 or the optional side handle 64 to move the door 41 in a substantially lateral direction toward the right panel 24 of the container 15 until portions of the top cradle 102 and the frame 100 of the bottom cradle 92 that are near the right bracket 86 restrict further movement of the door 41. The operator then pulls on the door handle 48 to move the door 41 in a substantially lateral direction toward the front panel 26 of the container 15 until the bite 50 of the door 41 presses against the seal 66, as shown in FIG. 5. If the seal 66 is not present, the bite 50 instead presses against the seat 70. In either case, the bolt holes 34 in the flange 32 are lined up to be coaxial with the holes 39 in the bite 50, and the door panel 42 covers the opening 16. The operator then places the bolts 36 into the respective bolt holes 34, 39 and 62 of the flange 32, bolt bracket 38 and bite 50 of the door 41.

Operation of a containment device 14 in which the door 41 interacts with the container 15 in a substantially upright direction is best described with reference to FIGS. 4, 11 and 12. As shown in FIGS. 4 and 11, the door 41 is covering the opening 16, and the bolts 36 are positioned in the respective bolt holes 34, 39 and 62 of the flange 32, bolt bracket 38 and bite 50 of the door 41. Before opening the door 41 to uncover the opening 16, an operator removes the bolts 36 from the bolt holes 34, 39 and 62. The operator then pushes the door 41 in a substantially lateral direction toward the back panel 28 of the container 15 until the rollers 108 pass through the upper and lower openings 112 and 114 of the guide rails 110*a* and 110*b* and are aligned with the slot 116.

The operator then pushes the door 41 in a substantially upright direction toward the top panel 18 (FIG. 12) of the container 15. As the door 41 moves toward the top panel 18, the slots 116 in the guide rails 110*a* and 110*b* guide the rollers 108 along the guide rails 110*a* and 110*b*. The guide rails 110*a* and 110*b* direct the rollers 108 toward the top panel 18, and then toward the back panel 28 until the door 41 contacts the back panel 28 of the container 15. When the door 41 contacts the back panel 28, the door 41 is substantially parallel to the interior surface 82 of the top panel 18 of the container 15. With the door 41 opened, the operator has access to the container 15 through the opening 16 to place items into, and remove items from, the cargo hold 17.

To close the door 41, the operator pulls on the door handles 48 or the optional side handle 64 in a substantially downward direction to move the door 41 toward the bottom panel 20 of the container 15 until the door 41 contacts the bottom panel 20. The operator then pulls on the door handles 48 to move the door 41 in a substantially lateral direction toward the front panel 26 of the container 15 until the bite 50 of the door 41 presses against the seal 66. If the seal 66 is absent, the bite 50 instead presses against the flange 32 or seat 70. In either case, the door panel 42 covers the opening 16, and the bolt holes 34 in the flange 32 are lined up to be coaxial with the holes 39 in the bite 50. The operator then places the bolts 36 into the respective bolt holes 34, 39 and 62 of the flange 32, bolt bracket 38 and bite 50 of the door 41.

Should an explosive detonation occur in the cargo hold 17, a resultant explosive force on the door panel 42 will be transferred to the bite 50 and cause the bite 50 to press against the seal 66 to form an airtight seal between the bite 50 and the container 15. It is important for the present invention that the bolts 36 not prevent the bite 50 from pressing against the seal 66 when the seal 66 is present. For example, the bolts 36 may be constructed to shear when an explosive force on the door panel 42 is transferred to the bite 50 and which forces the bite 50 against the seal 66 or the seat 70. It is also possible to form the bolt holes 62 of the bite 50 to have a larger size than is necessary to accommodate the bolts 36. In this situation, the bolts 36 will not shear but will move relative to the bolt holes 62 when the bite 50 is forced against the seal 66 or the seat 70.

When the bite 50 is pressed into the seal 66, the seal 66 prevents gasses from flowing into, or flowing out of, the cargo hold 17. For example, the seal 66 will prevent leakage of hazardous or toxic materials from the cargo hold 17, and will also prevent ambient air from entering the container 15, which may promote deflagration in the cargo hold 17. Additionally, the seal 66 transfers the explosive force from the bite 50 to the front panel 26 of the container 15 and uniformly distributes the explosive force to the container 15 at the seat 70. If the optional seal 66 is absent from the seat 70, the bite 50 instead transfers the explosive force from the door panel 42 to the container 15 and uniformly distributes the explosive force to the container 15 at the seat 70.

Whether or not the seal 66 is present, the bite 50 prevents the door 41 from warping as a result of the explosive blast while uniformly distributing the explosive force to the container 15. Furthermore, the bite 50 bonds tightly to the seat 70 in response to an explosive force in the cargo hold 17 to balance the in-plane tension stresses in all directions on the door panel 42. Because the container 15 is formed of a unitary construction, a concentration of tension stresses from the explosive force are reduced in the container 15. Accordingly, the door panel 42 and the container 15 will resist rupturing when subjected to tension stresses caused by the explosive blast.

While the particular blast resistant containment device and method as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. An explosion resistant containment device, said device comprising:

a container surrounding a cargo hold, said container having an opening defined by an edge;

a flange formed on said container at said edge of said opening to project inwardly from said edge to establish a seat between said flange and said container around said opening;

a door having a panel circumscribed by a border, with a bite formed on said panel at said border to extend away from said panel and dimensioned to contact said seat, wherein said door is dimensioned to cover said opening with said panel when said bite is pressed against said seat;

a means for holding said door inside said container and over said opening to resist an explosion in the cargo hold;

a first cradle mounted to a first surface inside said container; and a second cradle mounted to a second surface inside said container, where said first surface is substantially parallel to said second surface, and said door is positioned between said first cradle and said second cradle for guiding movement of said door in a substantially lateral direction inside said container when said door retracts internally into said cargo hold to expose said opening in said container.

2. A device as recited in claim 1, wherein said container has a unitary construction.

3. A device as recited in claim 2, wherein said container further includes a plurality of panels, each having a periphery, said plurality of panels joined at said peripheries to form said container with a unitary construction.

4. A device as recited in claim 2, wherein said flange is formed on said container with a unitary construction.

5. A device as recited in claim 1, said device further comprising a seal affixed to said seat of said container to establish an air-tight lock between said bite and said container in response to internal pressure in said cargo hold.

6. A device as recited in claim 5, wherein said seal is made of an elastomeric material.

7. A device as recited in claim 5, wherein said internal pressure is caused by an explosive blast in said cargo hold.

8. A device as recited in claim 1, wherein said means for holding said door over said opening comprises a plurality of bolts engagable with said bite and said flange to hold said door over said opening.

9. A device as recited in claim 1, wherein said bite is formed on said door panel with a unitary construction.

10. A device as recited in claim 1, wherein said door has a rectangular shape.

11. A device as recited in claim 1, wherein said bite has a hollow core.

12. A device as recited in claim 1, wherein said door further includes at least one door handle mounted to said door for moving said door.

13. An explosion resistant containment device, said device comprising:

a container surrounding a cargo hold, said container having an opening defined by an edge to provide access to said cargo hold, and a flange formed around said edge of said opening and extending into said cargo hold to establish a seat inside said container between said flange and said container;

a door having a panel circumscribed by a border, said panel having a surface and a bite formed along said border on said surface, wherein said bite extends away from said surface and is dimensioned to contact said seat when said bite is positioned against said seat for covering said opening with said panel;

a means for holding said door over said opening in response to an explosive blast in said cargo hold;

a first cradle mounted to a first surface inside said container; and a second cradle mounted to a second surface inside said container, where said first surface is substantially parallel to said second surface, and said door is positioned between said first cradle and said second cradle for guiding movement of said door in a substantially lateral direction inside said container when said door retracts internally into said cargo hold to expose said opening in said container.

14. A device as recited in claim 13, said device further comprising a means for sealing said door to said container in response to an explosive blast in said cargo hold.

* * * * *